US006199289B1

(12) United States Patent
Baechler

(10) Patent No.: US 6,199,289 B1
(45) Date of Patent: Mar. 13, 2001

(54) DEVICE FOR MEASURING THE THICKNESS AND/OR UNEVENNESS OF WADDING OR NON-WOVENS

(75) Inventor: François Baechler, Uster (CH)

(73) Assignee: Zellweger Luwa AG, Uster (CH)

( * ) Notice: Subject to any disclaimer, the term of this patent is extended or adjusted under 35 U.S.C. 154(b) by 0 days.

(21) Appl. No.: 09/155,309

(22) PCT Filed: Mar. 12, 1997

(86) PCT No.: PCT/CH97/00102

§ 371 Date: Nov. 19, 1998

§ 102(e) Date: Nov. 19, 1998

(87) PCT Pub. No.: WO97/36031

PCT Pub. Date: Oct. 2, 1997

(30) Foreign Application Priority Data

Mar. 27, 1996 (CH) ..... 791/96

(51) Int. Cl.[7] ..... G01B 5/06; D01G 25/00

(52) U.S. Cl. ..... 33/501.02; 33/526; 19/65 A; 19/239

(58) Field of Search ..... 33/501.02, 501.03, 33/501.04, 526, 527; 19/65 A, 239; 73/159

(56) References Cited

U.S. PATENT DOCUMENTS

| | | | | |
|---|---|---|---|---|
| 477,818 | * | 6/1892 | Paterson | 33/501.03 |
| 3,916,662 | * | 11/1975 | Arnold | 72/31.07 |
| 4,777,729 | * | 10/1988 | Hausler | 33/501.03 |
| 4,881,415 | | 11/1989 | Hergeth | 73/865.8 |
| 4,903,750 | * | 2/1990 | Ives | 164/151.2 |

FOREIGN PATENT DOCUMENTS

| | | | | |
|---|---|---|---|---|
| 38 34 110 | | 4/1990 | (DE) . | |
| 0 455 014 | | 11/1991 | (EP) . | |
| 0 467 117 | | 1/1992 | (EP) . | |
| 0 679 862 | | 11/1995 | (EP) . | |
| 158509 | * | 9/1983 | (JP) | 33/501.02 |
| 4-034024 | | 2/1992 | (JP) . | |
| 148263 | * | 1/1962 | (SU) | 33/501.02 |
| 202527 | * | 9/1967 | (SU) | 33/501.02 |

* cited by examiner

*Primary Examiner*—Diego Gutierrez
*Assistant Examiner*—Maria Fernandez
(74) *Attorney, Agent, or Firm*—Burns, Doane, Swecker & Mathis, L.L.P.

(57) ABSTRACT

The invention concerns a device for measuring the thickness and or unevenness of wadding or non-wovens. The device has a guide element (30) for the wadding or non-wovens and a thickness sensor (26, 27, 28) which presses the wadding or non-wovens against the guide element and can move relative to the latter, the position of the sensor providing a measure of the thickness and/or unevenness of the wadding or non-wovens. To achieve a simpler and cheaper design without sacrificing measurement accuracy, an individual sensor is provided with a translation element (31) which converts the deflections of the individual sensor in one direction into a path signal available in another direction. This allows signals corresponding to the deflections of several individual sensors to be added together and applied to a single common path measurement system (32).

10 Claims, 2 Drawing Sheets

Fig. 4
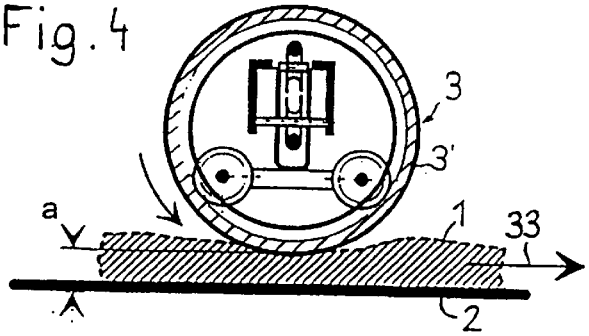
Fig. 5
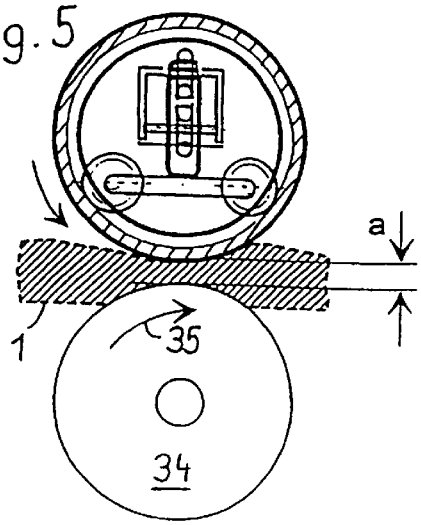
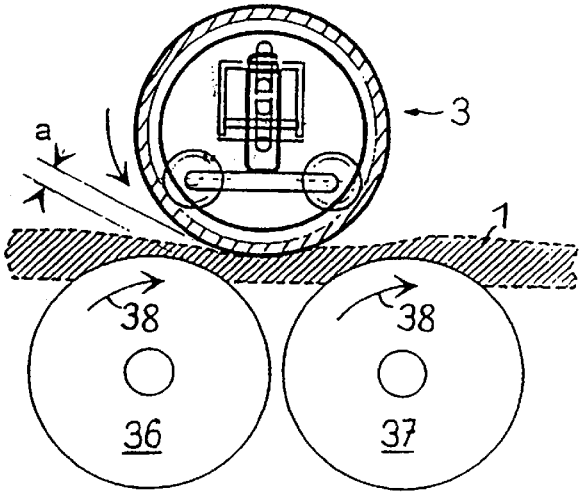
Fig. 6
Fig. 7
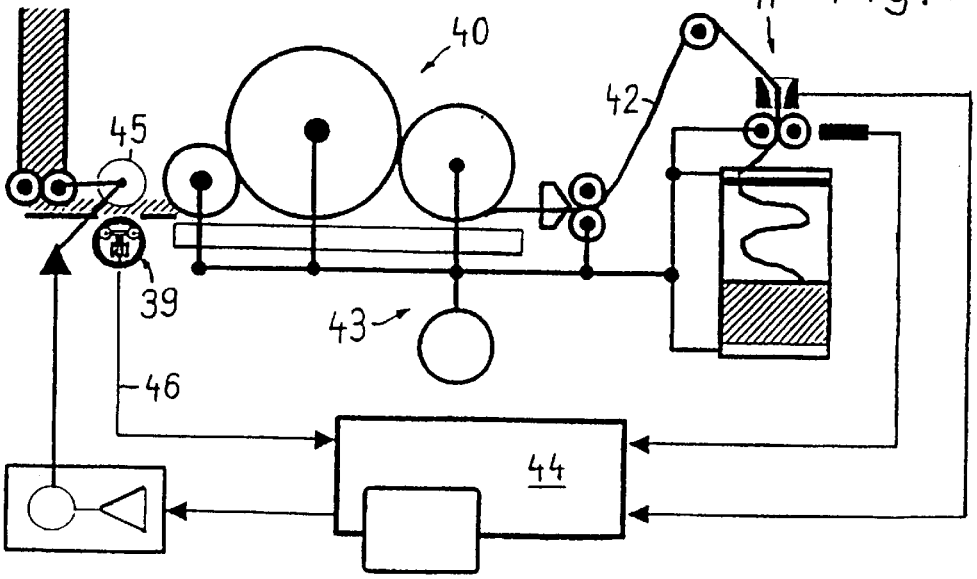

DEVICE FOR MEASURING THE THICKNESS AND/OR UNEVENNESS OF WADDING OR NON-WOVENS

FIELD OF THE INVENTION

The invention relates to a device for measuring the thickness and/or non-uniformity of waddings or non-wovens, described hereinafter as "laps", with a guide for the lap, with a thickness-sensing element which presses the said lap against the said guide and is movable relative to the latter and the position of which represents a measure of the thickness and/or non-uniformity of the lap, and with a path measuring system.

BACKGROUND OF THE INVENTION

A device of this kind is already known from EP-A-0467117. In the said device, the thickness-sensing element is formed by a plurality of individual sensing elements disposed side by side, which can be individually shifted by the lap and extend over the breadth of the latter. Disposed in each individual sensing element is an electrical measuring device for detecting the position of the individual sensing element in relation to the guide. Signals for the position of each individual sensing element are thereby available which make it possible to identify differences which exist in the thickness of the lap, viewed over the breadth of the latter.

SUMMARY OF THE INVENTION

A disadvantage of this known device consists in the fact that the disposition of an electrical measuring device in each individual sensing element is extravagant and costly. If the measuring device operates with expansion-measuring strips, each individual measuring device has to be careful calibrated before starting, and this is an expensive process.

It is therefore an object of the present invention, such as is characterized in the patent claims, to provide a device of this kind which is simpler and cheaper, without it being necessary to accept losses in the quality of the measurements.

This is achieved through the fact that a thickness-sensing element is provided with a transmission element which transmits the movement of the thickness-sensing element to the path-measuring system in a direction which does not coincide with the direction of movement of the thickness sensing element. As a result of this, it is possible to provide a path-measuring system operating in a direction which can be selected at will.

Apart from the simpler construction of a device of this kind, there is the further advantage that the deflections of all the individual sensing elements are added at the same time, so that a signal is produced which represents the average thickness of the lap. This signal thus no longer needs to be ascertained by electrical processing of individual signals. The device can be designed in a simple manner for one, two or more individual sensing elements or even extended at a subsequent time to a number of individual sensing elements. In addition, it is possible to provide a path-measuring system operating in a direction which can be selected at will. When the device according to the invention is employed in a carder with an open regulating circuit, it is possible to supply the latter direct with a value for the thickness of the lap which is averaged over the breadth, a fact which permits more accurate regulation and leads to improved uniformity of the band at the outlet of the carder.

BRIEF DESCRIPTION OF THE DRAWINGS

The invention will be explained in greater detail below with the aid of exemplified embodiments and drawings. In the latter:

FIG. 7 shows a diagrammatic representation of the device on a carder.

DETAILED DESCRIPTION OF THE PREFERRED EMBODIMENTS

Figure 1:
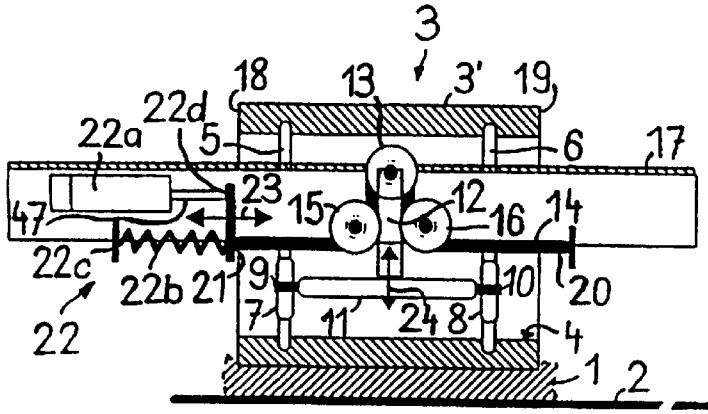
FIG. 1 shows a diagrammatic representation of a thickness sensing element according to the invention, in a longitudinal section.

FIG. 1 shows a device according to the invention. In the figure, there can be seen a lap 1 which rests on a fixed guide 2 and preferably appears in the form of a loose fibrous structure such as, for example, wadding or a non-woven, which will hereinafter be described as a "lap". A thickness-sensing element 3 is provided which rests on, or even sinks into, the lap 1 and is constructed here, in particular, as a hollow measuring roll 3. The inner face 4 of the measuring roll 3' has two annular grooves 5, 6 which serve for the lateral guidance of pairs of rollers 7, 8 which are supported on the measuring roll 3'. The pairs of rollers 7, 8 have swivel pins 9, 10 which are mounted in a carriage 11. The said carriage has a support 12 which serves for mounting a rerouting roller 13 for a transmission element 14 which is to be flexible but as inelastic as possible and, in this case for example, is constructed as a cable. Two other rerouting rollers 15, 16 are mounted on beam 17 which projects beyond end faces 18, 19 of measuring roll 3' and in which one end 20 of the transmission element 14 is fixedly mounted. The other end 21 of the transmission element 14 is connected to a path-measuring system 22 and moves in the direction of an arrow 23 when the measuring roll 3' is moved towards or away from the guide 2. The arrow 23 thereby indicates a direction which is inclined or bent in relation to a direction of movement of the thickness-sensing element 3 such as is indicated by an arrow 24. In addition to the actual measuring element 22*a*, the path-measuring system 22 also consists of a spring 22*b*, an adjustable bearing 22*c* for the spring 22*b* on the beam 17 and a coupling element 22*d* for the transmission element 14 which, this case, also serves as a measuring face for the actual oath-measuring element 22*a*. It can also be seen here, that a movement of the measuring roll 3' in the direction of the arrow 24 results, because of the formation of a loop in the transmission element 14, in twice as great an excursion of the end 21 in the region of the path-measuring system 22. It is thereby also possible to achieve a doubling of the measuring accuracy. The contact pressure of the thickness-sensing element 3 against the guide 2 is produced by the spring 22*b* (in addition to the force of gravity).

Figure 2:
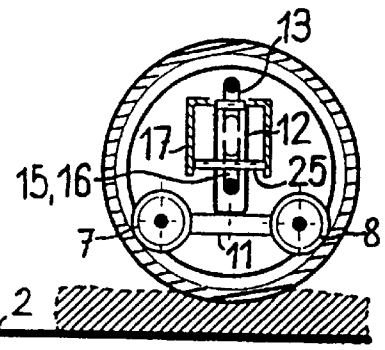
FIG. 2 shows a diagrammatic representation of a thickness sensing element according to FIG. 1, in cross section.

FIG. 2 shows a cross section through the device shown in FIG. 1. It is again possible to see therein the pair of rollers 7, 8, the carriage 11 with the support 12 and the rerouting roller 13, and also the beam 17 with a rerouting roller 15, 16 and a spindle 25 for the mounting thereof in the beam 17. As is apparent from FIGS. 1 and 2, the guide 2 essentially forms a plane in this case.

Figure 3:
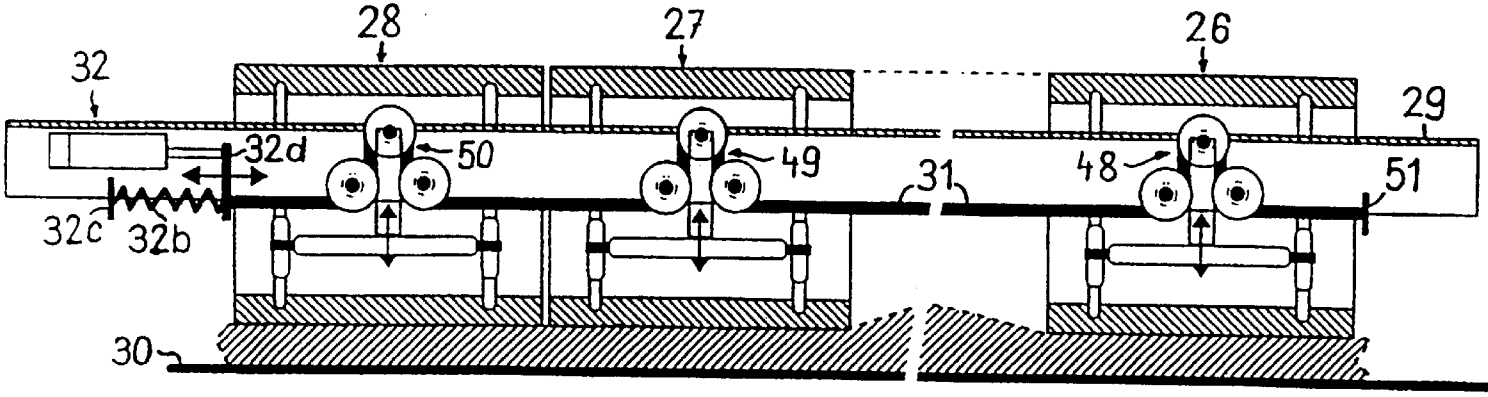
FIG. 3 shows a diagrammatic representation of a thickness sensing element with a number of measuring rolls, in longitudinal section, FIGS. 4, 5 and 6 each show another embodiment of the device, in cross section.

FIG. 3 shows a device with three thickness-sensing elements 26, 27, 28 which, in this case, are all mounted on a common beam 29 above a guide 30. The construction of the thickness-sensing elements 26, 27, 23 is that which is already known from FIGS. 1 and 2. In this instance, the thickness-sensing elements 26, 27, 28 all have a common transmission element 31 and a common measuring system 32 which is fastened on the beam 29 on one side of the three thickness-sensing elements 26, 27, 28. The beam 29 may be connected, for example in a manner which is not represented in any greater detail here but is known, to the guide 30, may be supported thereon or may be mounted in some other way, in particular in a stationary manner and at a fixed distance from the guide. In this case, the transmission element 31 traverses a number of measuring rolls, which are disposed between the path-measuring system 32 and a fixed mounting 51. A fixed mounting 32*c* is also provided in the path-measuring system 32 for a spring 32*b* which is connected to the transmission element 31 via a coupling element 32*d*. The mounting 32*c* is displaceable and adjustable along the beam 29, so that the tensioning force of the spring 32*b* and, with it, also the contact pressure of all the thickness-sensing elements 26, 27, 28 provided, can be adjusted jointly.

FIG. 4 shows, once again, the use of a thickness-sensing element 3 according to the invention above a stationary and flat guide 2 with a lap 1 which is driven in the direction of an arrow 33 by means not shown here, and thereby drives the measuring roll 3'. In the region of the thickness-sensing element 3, the lap 1 undergoes compression, so that its height is reduced to an amount a.

FIG. 5 shows a thickness-sensing element 3, such as may be disposed above a round guide, in this case a roll 34 which is driven in the direction of an arrow 35. Here too, compression of the lap 1 to the amount a occurs.

FIG. 6 shows a thickness-sensing element-3 such as may be disposed above a multipart guide, in this case consisting of two rolls 36 and 37 which are driven in the direction of arrows 38. Here too, compression of the lap 1 to the amount a occurs.

FIG. 7 shows the application of a thickness-sensing element 39 according to the invention in the area surrounding a carder 40 with a can system 41 connected downstream thereof for depositing carded band 42. The carder and the color can system have a common mechanical or electrical drive 43 and a monitoring and regulating system 44. As is shown here, the thickness-sensing element 39 may be provided in the region of a draw-in roller 45 at the entry to the carder 40 and be connected to the monitoring and regulating system 44 via a line 46.

The way in which the device according to the invention works is as follows: The measuring roll 3' is lifted off from the guide 2 to a greater or lesser extent by the varying thickness of the-moving lap 1. In the process, a movement of the measuring roll 3' is transmitted, via the rollers 7, 8, the carriage 11, the support 12 and the rerouting roller 13, to the transmission element 14 which, under these circumstances, enlarges or diminishes a loop which it forms in the region of the rerouting rollers 13, 15, 16. As a result of the movement of the transmission element, a transmitter in the path-measuring system 22 is deflected to a greater or lesser extent, and this supplies the indication concerning the thickness or uniformity of the lap 1. Instead of the transmitter 47, however, it is also possible for the path-measuring system 22 to operate in a contact-less manner.

In the event of a number of such thickness-sensing elements 26, 27, 28 being disposed side by side, the deflections of three loops 48, 49, 50 are added up, so that there is produced, at that end of the transmission element which is fastened to the path-measuring system 32, a signal which corresponds to the averaged thickness of the lap 1. Since all the loops 48, 49, 50 start out from an average deflection, even in the case of a zero thickness of the lap 1, very small thicknesses on one measuring roll are set off against larger thicknesses on another measuring roll. In the case of a number of thickness-sensing elements connected in series, as is known from FIG. 3, the path-measuring system 32 must also be calibrated in a corresponding manner.

What is claimed is:

1. Apparatus for measuring the thickness or nonuniformity of waddings or non-wovens, described hereinafter as laps, said apparatus comprising a guide for the lap being measured, a thickness-sensing element which presses said lap against said guide and is movable relative to said guide so that the position of said thickness sensing element represents a measure of the thickness or non-uniformity of the lap, a measuring system, and an elongated flexible transmission element extending along a path having multiple directions, said transmission element being constructed and disposed for the transmission of the movement of the thickness-sensing element to the measuring system in a direction which is at a desired inclination relative to the direction of movement of the thickness-sensing element.

2. Apparatus according to claim 1, wherein said flexible transmission element is rerouted around rollers and is fixedly mounted at one end and connected to the measuring system at the other end.

3. Apparatus according to claim 1, wherein the thickness-sensing element comprises a measuring roll which is mounted movably and rotatably on a beam which is at a fixed distance from the guide.

4. Apparatus according to claim 3, wherein the measuring roll is hollow, the beam traverses the said measuring roll and, at the same time, projects beyond at least one end face (18, 19) of the said measuring roll.

5. Apparatus according to claim 1, including a number of thickness-sensing elements disposed side by side, and wherein said transmission element extends over a number of said thickness-sensing elements.

6. Apparatus according to claim 5, wherein said transmission element transmits the movements of said number of thickness-sensing elements to said measuring system.

7. Apparatus according to claim 2, wherein said transmission element is disposed so as to traverse a number of measuring rolls which are provided between the measuring system and the fixedly mounted end of said transmission element.

8. Apparatus according to claim 2, wherein said transmission element forms a loop at the thickness-sensing element, so that the path of the deflections of the thickness-sensing element is doubled for detection in the measuring system.

9. Apparatus according to claim 2, wherein the transmission element is connected, in the region of the measuring system, to a spring which is adjustable to exert an adjustable force for pressing the thickness-sensing element toward said guide.

10. Apparatus according to claim 9, wherein adjustment of a single spring adjusts the pressing force of a number of thickness-sensing elements.

* * * * *